US010986945B2

(12) United States Patent
Miles

(10) Patent No.: US 10,986,945 B2
(45) Date of Patent: Apr. 27, 2021

(54) SPRUNG PILLOW

(71) Applicant: Alexander Miles, Porth Mid Glamorgan (GB)

(72) Inventor: Alexander Miles, Porth Mid Glamorgan (GB)

( * ) Notice: Subject to any disclaimer, the term of this patent is extended or adjusted under 35 U.S.C. 154(b) by 287 days.

(21) Appl. No.: 16/084,137

(22) PCT Filed: Mar. 31, 2017

(86) PCT No.: PCT/GB2017/050910
§ 371 (c)(1),
(2) Date: Sep. 11, 2018

(87) PCT Pub. No.: WO2017/174967
PCT Pub. Date: Oct. 12, 2017

(65) Prior Publication Data

US 2020/0288890 A1 Sep. 17, 2020

(30) Foreign Application Priority Data

Apr. 7, 2016 (GB) ..... 1605952
Feb. 2, 2017 (GB) ..... 1701724

(51) Int. Cl.
*A47G 9/10* (2006.01)

(52) U.S. Cl.
CPC ..... *A47G 9/10* (2013.01)

(58) Field of Classification Search
CPC ..... A47G 9/10; A47G 9/1009; A47G 9/1054; A47G 9/109
See application file for complete search history.

(56) References Cited

U.S. PATENT DOCUMENTS 178,515 A * 6/1876 Degenhart ..... A47G 9/10 5/491
774,996 A 11/1904 Starkwather
1,206,775 A * 11/1916 Everts ..... A47G 9/10 5/645
2,944,266 A * 7/1960 Wertheimer ..... A47G 9/10 5/645
3,443,267 A 5/1969 Schuckman
3,462,776 A * 8/1969 Cox ..... A47G 9/10 5/636

(Continued)

FOREIGN PATENT DOCUMENTS

DE 202014007813 U1 12/2014
GB 2256795 A * 12/1992 ..... A47C 27/121
WO 20171077109 A1 5/2017

OTHER PUBLICATIONS

International Written Opinion for International Application No. PCT/GB2017/050910 dated Jul. 26, 2017, 7 pages.

(Continued)

*Primary Examiner* — David R Hare
(74) *Attorney, Agent, or Firm* — TraskBritt

(57) ABSTRACT

A pillow comprises an outer pillow shell case defining an inner pillow filling cavity for receiving filling material, wherein an internal member is provided inside the inner pillow filling cavity and attached to opposed ends of the outer pillow case shell, the internal member being configured to limit lateral expansion of the outer pillow shell case when the pillow is compressed in use.

10 Claims, 3 Drawing Sheets

(56) References Cited

U.S. PATENT DOCUMENTS

| | | | | | |
|---|---|---|---|---|---|
| 4,768,248 | A * | 9/1988 | O'Sullivan | A47G 9/10 | 5/640 |
| 5,038,432 | A * | 8/1991 | Robillard | A47G 9/10 | 5/645 |
| 5,644,810 | A * | 7/1997 | Kato | A47G 9/109 | 5/645 |
| 5,661,862 | A * | 9/1997 | Ryndak | A47G 9/10 | 5/636 |
| 5,778,470 | A * | 7/1998 | Haider | A47G 9/10 | 5/645 |
| 6,760,935 | B1 * | 7/2004 | Burton | A47G 9/10 | 5/636 |
| 7,080,421 | B1 * | 7/2006 | Delfs | A47G 9/0207 | 5/502 |
| 7,213,280 | B2 * | 5/2007 | Lavin | A47G 9/109 | 5/630 |
| 7,467,432 | B2 * | 12/2008 | Brogan | A47G 9/10 | 5/636 |
| 7,562,405 | B2 * | 7/2009 | Brogan | A47G 9/10 | 5/645 |
| 8,656,537 | B2 * | 2/2014 | Leifermann | A47G 9/10 | 5/636 |
| 9,232,867 | B2 * | 1/2016 | Chang | A47G 9/10 | |
| 2017/0099967 | A1 * | 4/2017 | Holbrook | A47G 9/1081 | |
| 2017/0340131 | A1 * | 11/2017 | Schmidt | A47C 27/086 | |

OTHER PUBLICATIONS

International Search Report for International Application No. PCT/GB2017/050910 dated Jul. 26, 2017, 4 pages.

GB Office Action for GB Application No. 1814951.8, dated Oct. 1, 2020, 5 pages.

* cited by examiner

SPRUNG PILLOW

CROSS-REFERENCE TO RELATED APPLICATIONS

This application is a national phase entry under 35 U.S.C. § 371 of International Patent Application PCT/GB2017/050910, filed Mar. 31, 2017, designating the United States of America and published in English as International Patent Publication WO 2017/174967 A1 on Oct. 12, 2017, which claims the benefit under Article 8 of the Patent Cooperation Treaty to Great Britain Patent Application Serial No. 1701724.5, filed Feb. 2, 2017, and to Great Britain Patent Application Serial No. 1605952.9, filed Apr. 7, 2016.

TECHNICAL FIELD

This application relates to the design and structure of pillows and, in particular, the design and structure of a shell case of a pillow.

BACKGROUND

Prior art in the field of pillow design and structure is dominated by a simple fabric sealed envelope form filled with a selection of soft resilient and fibrous fillings. The general form of a pillow is two identical rectangles of fabric stitched together to form a closed unit with a selection of fill materials and fill densities. It will be known that the primary purpose of a pillow is to offer comfortable rest to a person seeking relaxed sleep. Some designs have been developed that provide for a contoured surface form such that the neck area of the pillow is increased in height relative to the head area, which is at a reduced height, with the goal of providing a more natural alignment of the skeletal structure during sleep.

Still other designs provide for a type of memory effect whereby the fill material responds to the weight directly applied to it and deforms to create a profiled surface that matches the shape and position of the user.

However, in general, the vast majority of pillow forms are simple closed envelopes with filling. The filling can range from wool fibers to polyester fibers, feathers or down, and many other materials.

In all of the above examples, there is no scientific solution to the issue of head cossetting in all horizontal and vertical directions. For example, a person's head when rested on a pillow will naturally depress the pillow in the center below the head and neck. This depression of the pillow will simply reduce the height at which the person's head rests above the pillow base/mattress top. It is thus indeterminate whether the person's head will be at the optimum height for balanced sleep and skeletal alignment. Lateral support and head cossetting will also be indeterminate.

Those pillows which include sculpted contours and or memory effects can only adopt an average approximate position and level of comfort that does not suit all users.

BRIEF SUMMARY

In accordance with the present disclosure, there is provided a pillow comprising an outer pillow shell case defining an inner pillow filling cavity for receiving filling material, wherein an internal member (e.g., tension member) is provided inside the inner pillow filling cavity and attached to the outer pillow case shell.

In one embodiment, the internal member is attached (e.g., by means of a sewn connection) to opposed ends of the outer pillow case shell. Typically the outer pillow shell case defines upper and lower faces (e.g., rectangular or square panels), a pair of opposed side ends (defining the width of the pillow), and opposed top and bottom ends (defining the height of the pillow).

In one embodiment, the internal member is attached to opposed side ends of the outer pillow case shell and/or opposed top and bottom ends.

In one embodiment, the internal member is attached to opposed corners of the outer pillow case shell.

In one embodiment, the internal member is configured to limit (e.g., contain) lateral expansion (e.g., expansion in width or height of the pillow) of the outer pillow shell case when the pillow is compressed in use (e.g., by a user's head resting on an upper face of the pillow). In this way, compression of the pillow will tend to force the pillow to expand upward around a user's head.

In one embodiment, the internal member comprises an internal divider (or baffle) operative to divide the inner pillow filling cavity into two internal filling cavities. In one embodiment, the two internal filling cavities comprise a top cavity and a bottom cavity (e.g., with the internal divider extending substantially horizontally when the pillow is placed on a horizontal surface in a filled, non-compressed state). Typically the internal divider will take the form of a sheet of material.

In one embodiment, the downward force of a head resting on the pillow causes the internal member (e.g., internal divider) to bow downward in the center, resulting in pulling forces on edges of the internal divider attached to the outer pillow shell case creating a curling upward rounding of the outer pillow shell case and filling material.

In one embodiment, the internal divider acts as a spring (e.g., tension spring).

In one embodiment, the internal divider has a width substantially equal to or smaller than a width of the unfilled outer pillow shell case.

In one embodiment, the internal divider has a height substantially equal to or smaller than a height of the unfilled outer pillow shell case.

In one embodiment, the internal divider has a width that is smaller than the width of the unfilled outer pillow shell case and a height that is smaller than the height of the unfilled outer pillow shell case.

In one embodiment, the difference between the width of the internal divider and the width of the unfilled outer pillow shell case is different to (e.g., greater or smaller than) the difference between the height of the internal divider and the height of the unfilled outer pillow shell case.

In one embodiment, the internal divider has an open frame structure (e.g., comprising one or more apertures or notches). In this way, airflow through the pillow may be substantially maintained.

In one embodiment, the internal member (e.g., internal divider) is formed from a relatively non-extendible material (e.g., high tension material or relatively stiff (high modulus) elastic material). In one embodiment, the internal member (e.g., internal divider) is formed from cotton (e.g., comprises a sheet of cotton).

In one embodiment, a first of the two internal filling cavities is filled with a first quantity of a first filling material and a second of the two internal filling cavities is filled with a first quantity of a second filling material.

In one embodiment, the first quantity is the same as the second quantity and the first filling material is the same as the second filling material.

In one embodiment, the first quantity is the same as the second quantity and the first filling material is different from the second filling material.

In one embodiment, the first quantity is different from the second quantity and the first filling material is the same as the second filling material.

In one embodiment, the first quantity is different from the second quantity and the first filling material is different from the second filling material.

BRIEF DESCRIPTION OF THE DRAWINGS

Embodiments of the present disclosure will now be described by way of example with reference to the accompanying drawings in which.

DETAILED DESCRIPTION

Figure 1:
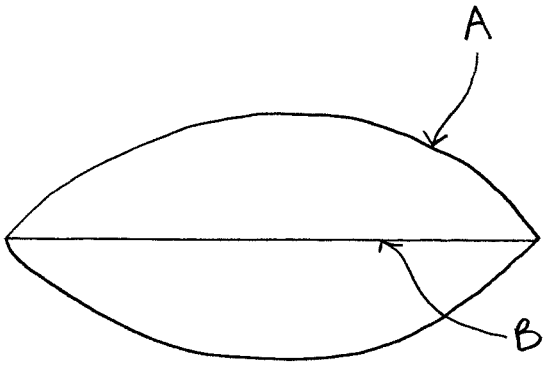
FIG. 1 is a schematic cross-sectional side view of a pillow in accordance with a first embodiment of the present disclosure.
Figure 2:
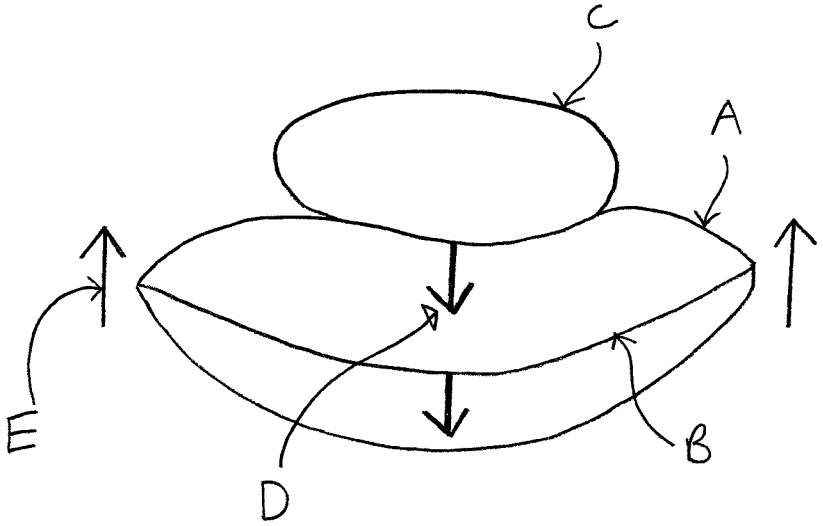
FIG. 2 is a schematic cross-sectional side view of the pillow of FIG. 1 with head engaged.

FIGS. 1 and 2 show a pillow comprising an outer pillow shell case A and an internal fabric divider (or "baffle") B to create two filling cavities, which by design and method of configuration creates a sprung pillow, which when filled with hollow fiber, natural/manmade fiber, foam, feather or down, provides a new type of sprung, reactive, supportive, pillow. As shown in FIG. 2, when a head C engages the pillow, the internal fabric divider B is depressed downward due to the downward force D of the head C. This, in turn, results in an upward force of sprung pillow.

By the provision of an extra fabric length in the center of the inside shell, attached by sewing or some other method of attachment to the outer pillow shell case, or any other arrangement of fabric to make a divider in the inner pillow filling cavity to create two filling cavities (see FIG. 1), a top cavity and a bottom cavity, which may end up being determined by whichever side is the head-engaging side, which would then be termed the top.

The result of this new design of pillow shell case with an internal divider creating two internal filling cavities, creates a spring effect on the central internal fabric divider. When the force of the head rests on the pillow, the downward force of the head resting on the pillow by its weight causes the central internal divider to bow downward in the center, resulting in pulling forces on the internal fabric divider edges attached to the outer pillow shell case, which creates the movement of a curling upward rounding of the pillow shell case and filling material, into the neck and lumbar region and around the head to provide extra comfort and support (see FIG. 2).

The movement of the pillow shell case and filling is a reactive response to the placing and movement of the head on the pillow, by means in greater part to the working of the internal central fabric divider acting as a spring.

The new pillow design, with the central fabric divider acting like a spring, makes the pillow more reactive and responsive to supporting the head when engaged upon a pillow.

When the head engages the new pillow design outer shell, it exerts a downward force through the top section cavity filling, which, in turn, exerts a force on the central spring fabric divider, depressing it, which then creates a pulling force on its edges as the center is depressed, causing the pillow shell case and filling to mold up into the neck and lumbar region and mold around the head, from the weight of the head exerted through the pillow (see FIG. 2).

The center divider also assists in returning the pillow to original shape when the head is removed from the pillow, acting like a spring naturally wanting to return to its former position.

This new design and method of construction is a new and novel was to create a pillow shell case.

Figure 3A:
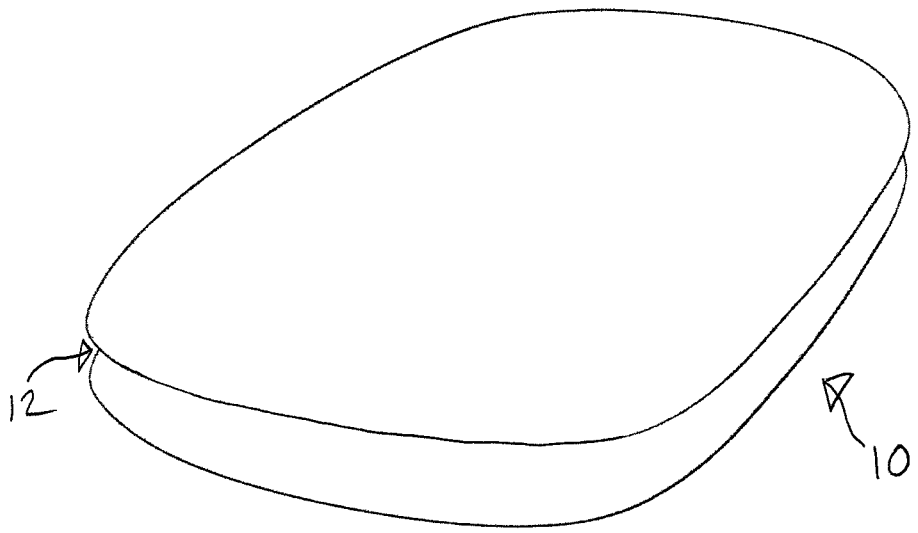
FIG. 3A is a schematic perspective view of a pillow in accordance with a second embodiment of the present disclosure.
Figure 3B:
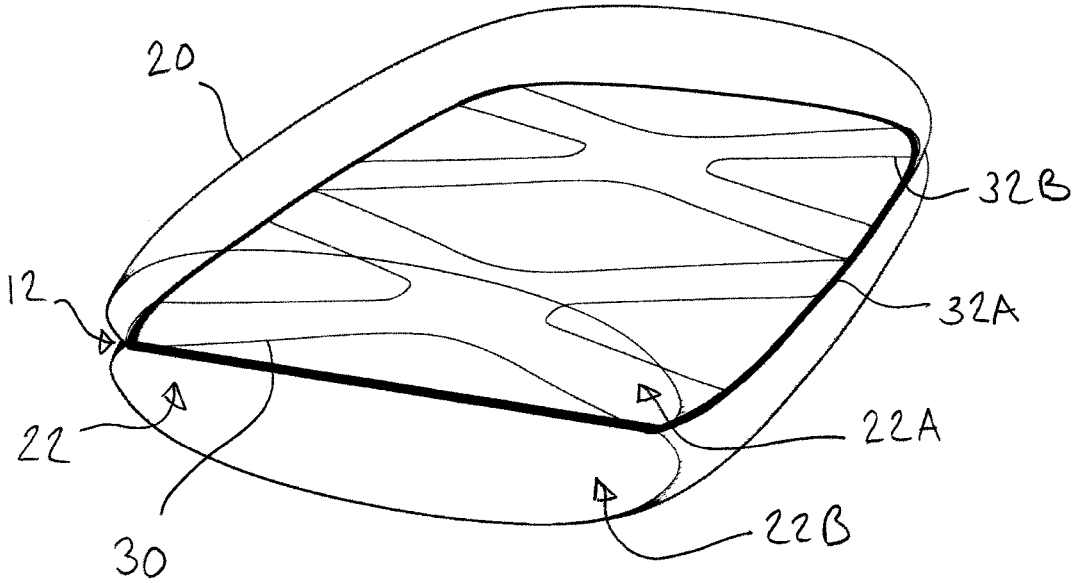
FIG. 3B is a schematic perspective view of the pillow of FIG. 3A showing a first proposed internal structure.
Figure 3C:
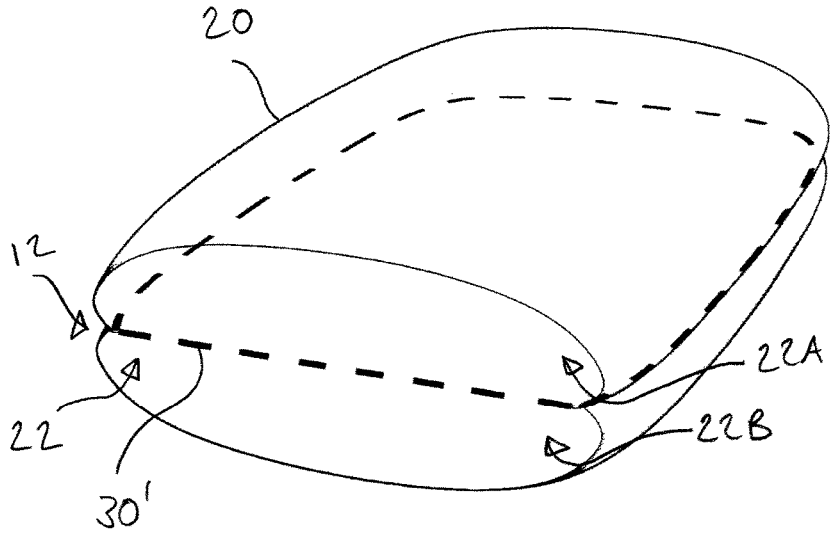
FIG. 3C is a schematic perspective view of the pillow of FIG. 3A showing a second proposed internal structure.

FIGS. 3A-3C show a pillow 10 in accordance with a second embodiment of the present disclosure.

Pillow 10 comprises a pillow shell case (or pillow envelope) 20 defining an inner pillow filling cavity 22 for receiving filling material. Pillow 10 further comprises an internal divider in the form of a mid-plane separation sheet 30, 30' of fabric secured to the outer edges of the pillow envelope 20. The separation sheet 30, 30' creates two distinct cavities within the overall pillow envelope—a top cavity 22A and a bottom cavity 22B. Each of the cavities 22A, 22B can be filled with differing materials and to different degrees of till density. In the example of FIG. 3B, the separation sheet 30 comprises an open framework formed by a pair of X-shaped members 32A, 32B. In the example of FIG. 3C, the separation sheet 30' comprises a continuous sheet of material.

Each separation sheet 30, 30' is dimensioned such that it is no larger and preferably smaller than the main pillow envelope 20 when filled. Thus, after appropriate filling with a suitable choice of material, the separation sheet 30, 30' can be understood to be substantially horizontal before use. In this example, the separation sheets 30, 30' are actually smaller in width and height than the main pillow envelope 20 when filled. Accordingly, an outer periphery of main pillow envelope 20 is drawn inward by separation sheet 30, 30' to form a waist region 12 extending around the entire periphery of the pillow 10.

The degree to which the separation sheet 30, 30' is dimensioned less than the main envelope 20 can be different in y direction (height direction) compared to x direction (width direction).

When the pillow is used, the person's head and neck depress the central area of the pillow 10. As the separation sheet 30, 30' is smaller than the outer envelope sections of pillow envelope 20, it exerts a tension on the outer seams to the extent that the outer sections of the pillow curl up where possible. Thus the neck area receives more upward support than the main head area and the outer zones of the pillow effectively and gently wrap the periphery of the head making a cossetting and supporting form that optimally balances the skeletal alignment while giving the person a soft but well-supported head platform.

The addition of the central separation sheet may further increase the pillow responsiveness and assist with the pillow returning to its before-use form.

The separation sheet assists with distributing the head weight over a larger area due to the tension created with the sheet and the consequent transfer of this tension to a larger area of filling material.

Figure 4A:
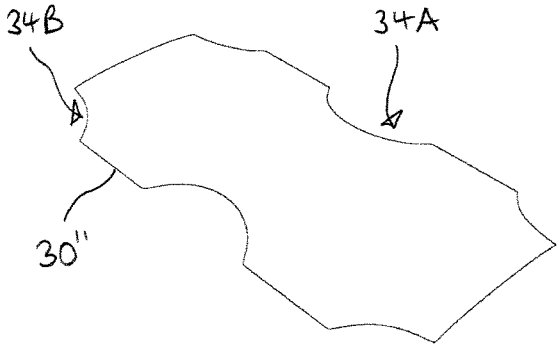
FIG. 4A is a schematic perspective view of another baffle design.
Figure 4B:
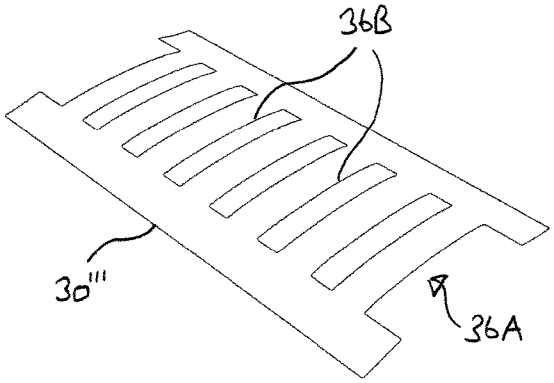
FIG. 4B a schematic perspective view of a yet further baffle design.

FIGS. 4A and 4B show alternative mid-plane separation sheets 30", 30''' for use as alternatives instead of sheets 30, 30'. As illustrated, sheet 30" includes a plurality of side notches 34A and corner notches 34B defining air flow paths around the sheet. Sheet 30''' includes end notches 36A together with a series of slots 36B, each of which allow air to flow around/through the sheet 30''' and between the top and bottom cavities.

The invention claimed is:

1. A pillow, comprising:

an outer fabric pillow shell case defining an inner pillow filling cavity for receiving filling material, and an internal member inside the inner pillow filling cavity and attached to opposed ends of the outer fabric pillow shell case, the internal member being configured to limit lateral expansion of the outer fabric pillow shell case when the pillow is compressed in use;

wherein the internal member comprises an internal divider operative to divide the inner pillow filling cavity into two internal filling cavities, the two internal filling cavities comprising a top cavity and a bottom cavity;

wherein the internal divider comprises an open framework comprising one or more apertures; and wherein the open framework is formed by a pair of X-shaped members.

2. The pillow of claim 1, wherein downward force of a head resting on the pillow causes the internal member to bow downward in a center location, resulting in pulling forces on edges of the internal member attached to the outer fabric pillow shell case creating a curling upward rounding of the outer fabric pillow shell case and filling material.

3. The pillow of claim 2, wherein the internal divider acts as a spring.

4. The pillow of claim 1, wherein a first of the two internal filling cavities is filled with a first quantity of a first filling material and a second of the two internal filling cavities is filled with a first quantity of a second filling material.

5. The pillow of claim 4, wherein the first quantity is the same as the second quantity and the first filling material is the same as the second filling material.

6. The pillow of claim 4, wherein the first quantity is the same as the second quantity and the first filling material is different to the second filling material.

7. The pillow of claim 4, wherein the first quantity is different to the second quantity and the first filling material is the same as the second filling material.

8. The pillow of claim 4, wherein the first quantity is different to the second quantity and the first filling material is different to the second filling material.

9. The pillow of claim 1, wherein the internal divider has a width smaller than a width of the outer fabric pillow shell case when the outer fabric pillow shell case is unfilled.

10. The pillow of claim 1, wherein the internal divider has a height smaller than a height of the outer fabric pillow shell case when the outer fabric pillow shell case is unfilled.

* * * * *